US007731342B2

(12) United States Patent
Mantell

(10) Patent No.: US 7,731,342 B2
(45) Date of Patent: Jun. 8, 2010

(54) IMAGE CORRECTION SYSTEM AND METHOD FOR A DIRECT MARKING SYSTEM

(75) Inventor: David A. Mantell, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 991 days.

(21) Appl. No.: 11/490,640

(22) Filed: Jul. 21, 2006

(65) Prior Publication Data

US 2008/0018710 A1 Jan. 24, 2008

(51) Int. Cl.
*B41J 2/115* (2006.01)

(52) U.S. Cl. ..... 347/80

(58) Field of Classification Search ..... 347/78–81
See application file for complete search history.

(56) References Cited

U.S. PATENT DOCUMENTS

| | | | | |
|---|---|---|---|---|
| 4,217,595 | A * | 8/1980 | Horike et al. | 347/80 |
| 4,286,273 | A * | 8/1981 | Horike | 347/80 |
| 4,680,645 | A | 7/1987 | Dispoto et al. | |
| 4,774,530 | A | 9/1988 | Hawkins | |
| 4,929,324 | A | 5/1990 | Watanabe et al. | |
| 5,045,952 | A | 9/1991 | Eschbach | |
| 5,162,916 | A | 11/1992 | Stemmle et al. | |
| 5,192,959 | A | 3/1993 | Drake et al. | |
| 5,198,054 | A | 3/1993 | Drake et al. | |
| 5,300,968 | A | 4/1994 | Hawkins | |
| 5,343,231 | A | 8/1994 | Suzuki | |
| 5,375,002 | A | 12/1994 | Kim et al. | |
| 5,434,672 | A | 7/1995 | McGuire | |
| 5,668,638 | A | 9/1997 | Knox | |
| 5,847,724 | A | 12/1998 | Mantell | |
| 6,068,361 | A | 5/2000 | Mantell | |

(Continued)

FOREIGN PATENT DOCUMENTS

JP 2005-205661 * 8/2005

(Continued)

OTHER PUBLICATIONS

Knox et al., "Threshold modulation in error diffusion", *Journal of Electronic Imaging*, vol. 2(3), pp. 185-192 (Jul. 1993).

(Continued)

*Primary Examiner*—Charlie Peng
(74) *Attorney, Agent, or Firm*—Carter, DeLuca, Ferrell & Schmidt, LLP

(57) ABSTRACT

A system and method for image correction in a direct marking system is provided using input scaling. The system and method utilize spatial dependent scale factors for each color of a liquid ink printer in the direct marking system. The value of each scale factor depends upon the ratio of the target mass to the average mass of the ink drops in the region to be corrected. The target mass is typically equal to or near the lowest average mass to insure that all regions can be adjusted to common output color. All input values received by the direct marking system and corresponding to a region to be corrected are multiplied by the appropriate scale factor to correct for drop volume variations among different printheads of the direct marking system. Each printhead includes a plurality of ejectors for depositing ink on a recording medium.

19 Claims, 3 Drawing Sheets

U.S. PATENT DOCUMENTS 6,533,181 B1 3/2003 Roxby et al.
6,693,726 B2 * 2/2004 Childs et al. ..... 358/2.1
6,766,817 B2 7/2004 da Silva
6,827,412 B2 * 12/2004 Inui et al. ..... 347/7
6,918,404 B2 7/2005 Dias da Silva
6,937,260 B2 8/2005 Williams et al.
7,066,586 B2 6/2006 da Silva
2007/0126792 A1 * 6/2007 Couwenhoven et al. ..... 347/43

FOREIGN PATENT DOCUMENTS

WO WO 03/019470 A1 3/2003

OTHER PUBLICATIONS

Quinn, "Direct Part Marking", www.scs-mag.com (Feb. 1998).

* cited by examiner

IMAGE CORRECTION SYSTEM AND METHOD FOR A DIRECT MARKING SYSTEM

BACKGROUND

The present disclosure relates to the field of image processing, and more specifically, the present disclosure relates to an image correction method for a direct marking system using input scaling.

Liquid ink printers of the type frequently referred to as continuous stream or as drop-on-demand, such as piezoelectric, acoustic, phase change wax-based, or thermal, have at least one printhead from which droplets of ink are directed towards a recording medium. Within the printhead, the ink is contained in a plurality of ink carrying conduits or channels. Power pulses cause the droplets of ink to be expelled as required from orifices or nozzles at the ends of the channels.

In a thermal ink-jet printer, the power pulse is usually produced by a heater transducer or a resistor, typically associated with one of the channels. Each resistor is individually addressable to heat and vaporize ink in the channels. As voltage is applied across a selected resistor, a vapor bubble grows in the associated channel and initially bulges toward the channel orifice followed by collapse of the bubble. The ink within the channel then retracts and separates from the bulging ink thereby forming a droplet moving in a direction away from the channel orifice and towards the recording medium whereupon hitting the recording medium a dot or spot of ink is deposited. The channel is then refilled by capillary action, which, in turn, draws ink from a supply container of liquid ink.

The ink-jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge and the combined printhead and cartridge assembly is attached to a carriage which is reciprocated to print one swath of information (equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. This procedure is repeated until the entire page is printed.

In contrast, the page width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Printers typically print color and/or monochrome images received from an image output device or document creator such as a personal computer, a scanner, or a workstation. The color images printed are produced by printing with several colored inks or colorants of different colors at a time. The color of the ink and amount of ink deposited by the printer is determined according to image information received from the document creator. The document creator provides an input digital gray-scale image, which is either defined in monochromatic terms, colorimetric terms, or both. The amount of gray level is typically defined by an input pixel value ranging from 0 to 255, where 0 is equal to white, 255 is equal to black, and value therebetween are shades of gray. Commonly this description may be part of a Page Description Language (PDL) file describing the document. In the case of computer generated images, colors defined by the user at the user interface of a workstation can be defined initially in color space of tristimulus values. These colors are defined independently of any particular device, and accordingly reference is made to the information as being "device independent".

The printer, on the other hand, has an output which is dependent on the device or "device dependent". This dependency is due, in part, to the fact that while the input digital gray scale image includes pixels having a wide range of gray scale values, the output image generated by the printer is a binary image formed from a plurality of ink drops or spots wherein the absence of a spot defines the level of white and the presence of a spot defines black. Consequently, a transformation must be made from the input digital gray scale image to the printed binary image since the binary image includes binary information which either has a gray level value of zero (white) or one (black), but not levels of gray therebetween. These transformations, from an input image to an output image, are made with a number of known algorithms, including an algorithm known as the error diffusion algorithm which converts the input gray scale image into high frequency binary texture patterns that contain the same average grayscale information as the input image.

Color printers also include an output which can be defined as existing in a color space called CMYK (cyan-magenta-yellow-key or black) which is uniquely defined for the printer by its capabilities and colorants. Such printers operate by the addition of overlapping multiple layers of ink or colorant in layers to a page. The response of the printer tends to be relatively non-linear. These colors are defined for a particular device, and accordingly reference is made to the information as being device dependent. Thus, while a printer receives information in a device independent color space, it must convert that information to print in a device dependent color space, which reflects a possible range of colors of the printer; and secondly, printing of that image with a color printer in accordance with the colors defined by the scanner or computer generated image.

Various printers and methods for printing images on a recording medium are illustrated and described in the following disclosures which may be relevant to certain aspects of the present disclosure.

In U.S. Pat. No. 4,680,645 to Dispoto et al., a method for rendering gray scale images with variable dot sizes is described. An error diffusion algorithm is used in conjunction with a printing technique that is capable of producing a range of dot sizes on paper. The error diffusion algorithm is used to determine the error of a dot whenever the dot is printed. The error is then diffused to adjacent pixels where instead of being used for weighting the pixel in a thresholding process, the error is used to determine the proper dot size for the pixel.

U.S. Pat. No. 5,045,952 to Eschbach describes a method of dynamically adjusting the threshold level of an error diffusion algorithm to selectively control the amount of edge enhancement introduced into an encoded output. The threshold level is selectively modified on a pixel by pixel basis.

U.S. Pat. No. 5,343,231 to Suzuki describes an image recording apparatus capable of correcting density unevenness. A test pattern is recorded and the degree of density unevenness of the recording elements of the recording head are calculated by reading the test pattern. The temperature of the recording head is detected and the degree of calculated density unevenness is corrected according to the detected temperature.

U.S. Pat. No. 5,375,002 to Kim et al. describes an error diffusion circuit and a method for adaptively compensating for the distortion of brightness and color with respect to neighboring pixels. An error diffusion circuit includes a color determining portion for adding CMY signals to a diffusion error to generate a current pixel value, comparing the current pixel value with sequentially supplied error lookup data to determine an address of error lookup data having the smallest error as output pixel color information, and applying the output pixel color information to the printer.

U.S. Pat. No. 5,434,672 to McGuire describes a pixel error diffusion method. Error distribution in printing and information processing systems is accomplished according to combined internal and external superpixel error diffusion techniques. For a particular superpixel, error amounts of a selected internal subject pixel are provided to another internal subject pixel until a determined or selected final pixel error value within the selected superpixel has been determined. The final internal error value is distributed among selected superpixels within a predetermined superpixel neighborhood.

"Threshold Modulation In Error Diffusion" by Knox and Eschbach, Journal of Electronic Imaging, July 1993, vol. 2, Pages 185 to 192, describes a theoretical analysis of threshold modulation in error diffusion. Spatial modulation of the threshold is shown to be mathematically identical to processing an equivalent input image with a standard error diffusion algorithm.

U.S. Pat. No. 5,847,724 to Mantell describes a method of printing an input digital gray-scale image by ejecting ink on recording medium through a plurality of ink ejecting orifices to form a binary image including a plurality of spots. The method of printing includes the steps of determining an ink spot characteristic or ink ejecting characteristic for at least one of the plurality of ink ejecting orifices, calculating a correction factor based on the characteristic, modifying an error diffusion algorithm with the calculated correction factor, and printing the binary image according to the modified error diffusion algorithm on the recording medium.

U.S. Pat. No. 6,068,361 to Mantell describes a method for rendering grayscale images with variable number of drops. An error diffusion algorithm is used in conjunction with a printing technique that is capable of producing multiple drops per pixel. The error diffusion algorithm is used to determine the error of a number of dots whenever a given number of dots are printed. The error is then diffused to adjacent pixels.

With respect to a direct marking system, where an ink-jet printer is used to print directly on a product or part, such as a microchip, plastic and metal components, and glass, the error correction methodologies described above are not always feasible or may require more calculations than needed for the direct marking system.

SUMMARY

According to the present disclosure, there is provided an image correction system and method for a direct marking system. The image correction system and method utilize spatial dependent scale factors for each color of a liquid ink printer in the direct marking system. The value of each scale factor depends upon the ratio of the target mass to the average mass of the ink drops in the region to be corrected. The target mass is typically equal to or near the lowest average mass to insure that all regions can be adjusted to common output color. All input values received by the direct marking system and corresponding to a region to be corrected are multiplied by the appropriate scale factor to correct for drop volume variations among different printheads of the direct marking system. Each printhead includes a plurality of ejectors for depositing ink on a recording medium.

The image correction method according to the present disclosure includes determining spatial dependent scale factors for each color of a liquid ink printer of the direct marking system, and correcting for drop volume variations among a plurality of printheads of the liquid ink printer using at least one of the determined spatial dependent scale factors. The step of correcting includes multiplying each of a plurality of input values received by the direct marking system and corresponding to the region to be corrected by the at least one of the determined spatial dependent scale factors.

The image correction system includes a controller executing programmable instructions for determining spatial dependent scale factors for each color of the liquid ink printer, and correcting for drop volume variations among a plurality of printheads of the liquid ink printer using at least one of the determined spatial dependent scale factors. The controller corrects for drop volume variations by multiplying each of a plurality of input values received by the direct marking system and corresponding to a region to be corrected by the at least one of the determined spatial dependent scale factors.

The present disclosure further includes a direct marking system which includes a liquid ink printer having plurality of printheads, and a controller for determining spatial dependent scale factors for each color of the liquid ink printer and correcting for drop volume variations among the plurality of printheads using at least one of the determined spatial dependent scale factors. The controller corrects for drop volume variations by multiplying each of a plurality of input values received by the direct marking system and corresponding to a region to be corrected by the at least one of the determined spatial dependent scale factors.

BRIEF DESCRIPTION OF THE DRAWINGS

Various embodiments of the present disclosure will be described herein below with reference to the figures wherein.

DETAILED DESCRIPTION

Figure 1:
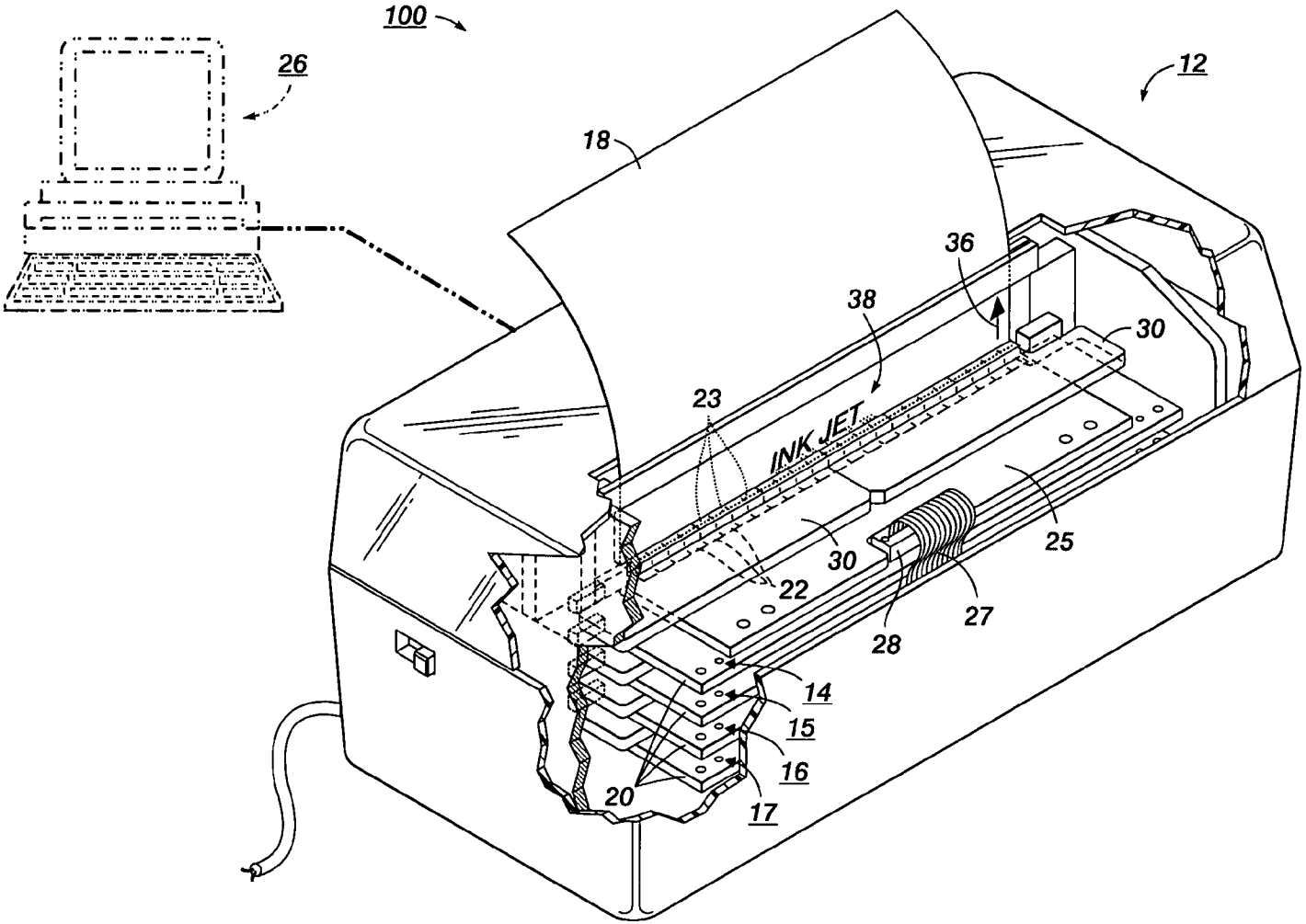
FIG. 1 is a partial perspective view of a multicolor, full width array liquid ink printer of a direct marking system in accordance with the present disclosure.

In FIG. 1, a multicolor liquid ink jet printer 12 of a direct marking system 100 is illustrated with four identical full width array printheads 14, 15, 16, and 17, disposed therein to produce a direct marking output on a recording medium 18, such as a metallic sheet. The printheads each comprise a structurally supporting substrate 20 which also functions as a heat sink and may optionally be cooled by the passage of a liquid coolant, such as water, through internal flow paths (not shown). Each printhead further includes an array of printhead subunits or printhead dies 22 affixed on the supporting substrate 20 in an abutted fashion, as taught by U.S. Pat. No. 5,198,054 to Drake et al. and incorporated herein by reference. Alternatively, individual subunits 22 of each printhead may be spaced apart from one another by a distance approximately equal to the length of a single subunit and bonded to each opposing surface of a supporting substrate 20, the subunits on one surface being staggered from the subunits on the other surface of the supporting substrate.

In one embodiment, subunits 22 may be similar in construction to U.S. Pat. No. 4,774,530 to Hawkins, the relevant portions of which are hereby incorporated by reference. The forward facing edges of the subunits 22 contain the droplet ejecting nozzles (ejectors) 23 of each printhead and are referred to as printhead subunit faces. The subunit faces are maintained in close proximity to the surface of recording medium or metallic sheet 18. Also affixed to substrate 20, at a position behind the abutted subunit array, is printed wiring board 26. Printed wiring board 26 contains the circuitry required to interface and drive the individual heating elements (not shown) in the subunits to eject ink droplets from the nozzles 23.

The data required to drive the individual heating elements of the printhead subunits is supplied from an external system, such as a personal computer 26 by a standard printer interface, modified and/or buffered by a printer micro processor (not shown) within the printer and transferred to the printheads 14, 15, 16, and 17 by ribbon cables 27, only one of which is shown, and pin-type connector 28.

Ink is supplied to the individual subunit nozzles 23 through ink channels (not shown) which connect the nozzles to subunit ink reservoirs (not shown). The subunit reservoirs have inlets which are aligned and sealed with outlets in ink manifolds. Further description of such an arrangement may be found in U.S. Pat. No. 4,929,324 to Drake et al., the relevant portions of which are hereby incorporated by reference. Ink is supplied to the manifold inlet connectors to which flexible hoses (not shown) connect an ink supply (not shown) located within the printer 12.

The location of full width array printheads 14, 15, 16, and 17 is particularly important in order to accurately position the nozzles of abutted printhead subunits 22, because multicolor printing requires accurate placement of the ink droplets from each printhead relative to one another in order to place one ink droplet on or adjacent to a previously ejected droplet on the recording medium 18, thereby achieving the desired final colored image.

As further illustrated in FIG. 1, recording medium 18 is fed in the direction of arrow 36 as ink droplets are ejected from the nozzles 23 to produce output images 38 including drops or spots of ink deposited thereon. The recording medium 18 is fed by conventional feeding mechanisms (not shown) and is maintained in close proximity to the subunit face of the subunits 22 making up the various full width array printheads by one or more recording medium guides which may contain several idler star wheels therein. The spacing between the front faces, which are all coplanar with one another, and the surface of the recording medium 18, is important to control the position of the ink droplets ejected from the individual nozzles. Furthermore, the spacing between the parallel and adjacent full width array printheads 14, 15, 16, and 17 must be maintained as close as possible and within very close tolerances.

While the spacing between the front face of the printhead dies and the recording medium is maintained to a fairly close tolerance, the amount of ink deposited to form a spot on the recording medium 18 does not always meet a designed-for nominal spot size (often measured as a diameter although spots are typically not truly circular). This variation in ink spot size results from a variety of factors which affect the ink drop volume or the amount of ink deposited on the recording medium 18. These factors can include variations in the physical dimensions of the ink carrying conduits and the ink ejecting orifices of ejectors 23, the flow of ink from the ink reservoirs to the ink carrying conduits, as well as the flow of ink therethrough. In addition, the thermal energy generated by the transducers can also vary resulting in ink spot sizes different than the nominal size desired.

It has been found that printheads that generate out of specification sized drops can produce printed images which do not have the appropriate contrast or color. While such a variation in drop size may not produce an undesirable image when printing in a low resolution draft mode, such a variation in drop size can be fatal to the production of printed images where either high quality or high resolution images are desired. In addition, it has been found that for a full width array printhead, ink spot size variations due to drop volume variations within a single printhead die may not be objectionable, but significant ink spot size variations due to drop volume variations from printhead die to printhead die can occur. This is especially undesirable since the eyes are very sensitive to differences in gray levels and color variations at the particular scale size of the individual printhead dies used to make a full width array printhead. While such printhead die variations can be controlled by testing and proper mating of like printhead dies, the cost can be prohibitive. Consequently, a method and apparatus is desired to account for ink spot size variation in a liquid ink printer.

Figure 2:
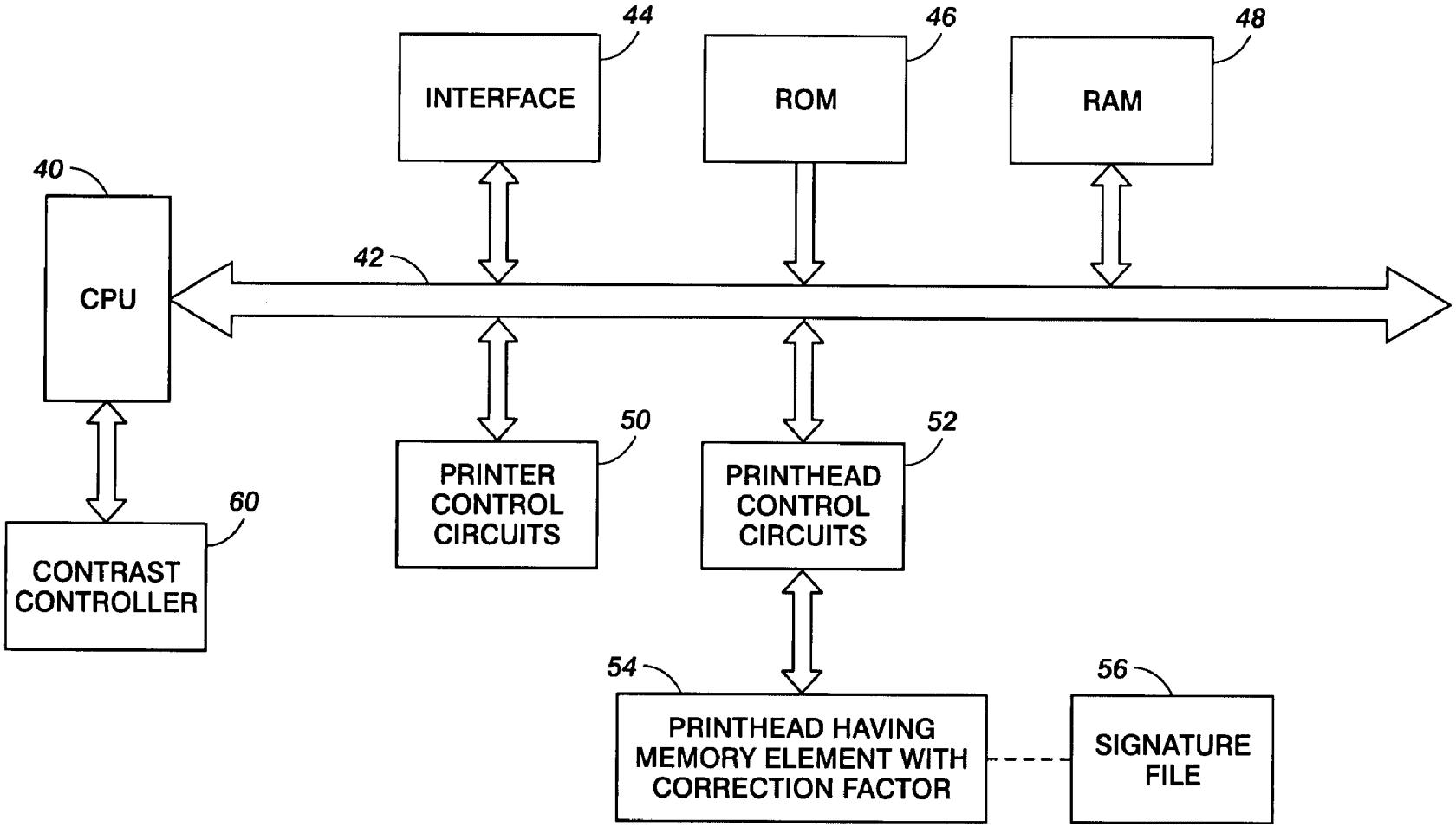
FIG. 2 is a schematic block diagram illustrating an embodiment of a control arrangement of an ink jet printer of the direct marking system incorporating the teachings of the present disclosure.

The printer 12 includes a control system capable of performing an image correction method using scale factors to account for ink spot size variation during direct marking in accordance with the present disclosure. As shown in FIG. 2, a controller or central processing unit (CPU) 40 is connected through a bus 42 to an interface 44 which, in turn, is connected to an external device such as the personal computer 26. The personal computer 26 provides information in the form of an input digital gray scale or an input digital color image (bitmap) to the printer 12 for printing.

The CPU 40 is also connected to a read only memory (ROM) 46 which includes an operating program for the CPU 40 as well as printing algorithms for manipulating print data, such as an error diffusion algorithm. One such error diffusion algorithm is described in U.S. Pat. No. 5,045,952, the relevant portions of which are hereby incorporated by reference. A random access memory (RAM) 48, connected to the bus 42, includes accessible memory including print buffers for the manipulation of data and for the storage of printing information in the form of bitmaps received from the host computer. In addition to the ROM 46 and the RAM 48, various printer control circuits 50 are also connected to the bus 42 for operation of the printing apparatus which includes feed driver circuits for feeding or holding a recording medium as is known by those skilled in the art.

The CPU 40 is programmed according to well known practices. It is commonplace to program and execute control functions and logic with software instructions for conventional or general purpose microprocessors. This is taught by various prior patents and commercial products. Such programming or software may, of course, vary depending on the particular functions, software type, and microprocessor or other computer system utilized but will be available to, or readily programmable, without undue experimentation from, functional descriptions, such as those provided herein, or prior knowledge of functions which are conventional, together with general knowledge in the software and computer arts. That can include object oriented software development environments, such as C++. Alternatively, the disclosed system or method may be implemented partially or fully in hardware, using standard logic circuits or a single chip using VLSI designs.

In particular, the controller 40 is programmed to perform the functions in accordance with the present disclosure, including correcting for drop volume variations among the printheads 14, 15, 16, and 17 and their ejectors of the liquid ink printer 12 using the input values received by the direct marking system 100 and corresponding to a region to be corrected and at least one of the determined spatial dependent scale factors.

The printheads 14, 15, 16, and 17 are controlled by the central processing unit 40 according to the content of signals received over the bus 42 and sent to various printhead control circuits 52. The printhead control circuits 52 control the thermal transducers for ejection of inks from the nozzles 23 of a printhead 54 incorporating an aspect of the present invention. A suitable controller for an ink jet printing apparatus is described in U.S. Pat. No. 5,300,968 to Hawkins, the relevant portions of which are hereby incorporated by reference.

It has been found that while error diffusion algorithms can be useful in generating binary images from input digital gray-scale images, error diffusion algorithms do not always produce acceptable images for ink jet printers. Ink jet printers can have difficulty with the black level or color level of prints due to recording medium/ink interactions or printheads that simply generate out of specification sized ink drops thereby producing images on the recording medium which do not have the appropriate contrast or color content. It has been found that by modifying the error diffusion algorithm, an adjustment for maintaining the proper black level or color level of an image printed on paper can be accomplished. This method is described in U.S. Pat. No. 5,847,724 to Mantell, the relevant portions of which are hereby incorporated by reference, and it applies to error diffusion algorithms where errors are distributed or diffused.

For the direct marking system 100, in accordance with the present disclosure there is provided a method for image correction using input scaling. The method utilizes spatial dependent scale factors for each color of the liquid ink printer 12. The value of each scale factor depends upon the ratio of the target mass to the average mass of the ink drops in the region to be corrected. The target mass is typically equal to or near the lowest average mass to insure that all regions can be adjusted to common output color. All input values received by the direct marking system 100 and corresponding to a region to be corrected are multiplied by the appropriate scale factor. The multiplication can be done before halftoning using a halftoner (not shown) of the direct marking system 100 or during halftoning. If the multiplication is done during halftoning, the data is handled only once; thereby, decreasing processing time. Alternately, other halftoning methods can be used, such as error diffusion.

It is important to note that the input to the halftoner in the direct marking system 100 is directly proportional to the amount of material put on the recording medium 18. Thus when scaling the input values, one is directly scaling the amount of ink put on the recording medium 18. Therefore, the ink deposited in an area with a larger drop can be directly scaled back to an equivalent amount of ink by scaling the proportion of the drops printed. This is not the case in a xerographic system. In a xerographic system, the amount of additional toner deposited with an incremental change in the input is a strong function of input level. Accordingly, corrections in a xerographic system require full toner reproduction curve (TRC) correction and they do not in a direct marking system.

The printhead 54 in the direct marking system 100, therefore, includes a spot size signature file 56 stored in a memory element resident on the printhead or in some other location in the system 100. The spot size signature file 56 contains information which includes ink ejecting characteristics for one or more of the ink ejecting orifices of the printhead and/or for individual printhead dies of the plurality of printheads 14, 15, 16, and 17.

Each of the printheads 14, 15, 16, and 17 can be designed to print multiple ink spot sizes by depositing different amounts of ink (commonly referred to as ink drop volume) and the signature file 56 can store multiple drop volumes for printing the multiple ink spot sizes as ink ejecting characteristics. Additional ink ejecting characteristics which can be stored by the signature file 56 are firing patterns and history of the firing patterns for each printhead. The firing pattern can relate to speed of firing (e.g., slow, intermediate and fast firing), whether the printhead was fired on specific potential pixels, and to the duty cycle (e.g. proportion of fired drops).

The spot size signature file 56 can also store signatures related to the temperature for each of the printheads 14, 15, 16, and 17 which can be obtained by one or more corresponding temperature sensors as ink ejecting characteristics, and number of ink drops per pixel for each of the printheads 14, 15, 16, and 17. Additionally, the signature file 56 can store signatures related to electrical firing characteristics of the printheads 14, 15, 16 and 17 which may affect the drop volume, such as voltage for energizing an ejector of a printhead.

The signature file 56 can also store the determined correction or spatial dependent scale factors for each of the colors which are used to scale the input values as illustrated by FIG. 2.

A drop volume is determined for each printhead as a function of printhead position (a look up table can be accessed which correlates printhead position with drop volume). The individual ink ejecting characteristics for each printhead stored by the signature file 56 can also be used independently, or in conjuction with printhead position and/or one or more other ink ejecting characteristics for determining drop volume for each printhead. That is, one or more other factors besides printhead position which can be used for determining drop volume include printhead temperature (a look up table can be accessed which correlates printhead temperature to drop volume), information related to printhead firing patterns (e.g., speed of firing and history of firing patterns) (a look up table can be accessed which correlates speed of firing to drop volume; the controller 40 can estimate the drop volume based on a historical firing pattern (a fast historical firing pattern can be equated to a high drop volume per pixel or per a given time unit)), and number of ink drops per pixel (a look up table can be accessed which correlates ink drops per pixel to drop volume).

If the determined drop volume corresponding to a particular printhead(s) is determined by the controller 40 to be outside a predetermined or desired range, then one or more of the ink ejecting characteristics stored by the one or more signature files 56, and/or each printhead's position and received input values, are used by the controller 40 to determine the correction or spatial dependent scale factors for each of the colors which are used to scale the input values. An exemplary predetermined drop volume range is the range of 5.0+/−0.1 pl. Correction is required if the determined drop volume is outside this range.

The spatial dependent scale factors for each printhead to be used for correcting for drop volume variations among the different colors are then determined by the controller 40 based upon the determined drop volume. In particular, if the drop volume needs to be increased to fall within the predetermined or desired range, the appropriate spatial dependent scale factor is increased, and conversely, if the drop volume needs to be decreased to fall within the predetermined or desired range, the appropriate spatial dependent scale factor is decreased.

The controller 40 then corrects for drop volume variations among the different printed colors by scaling or multiplying the input values for each color by the determined spatial dependent scale factors.

Figure 3:
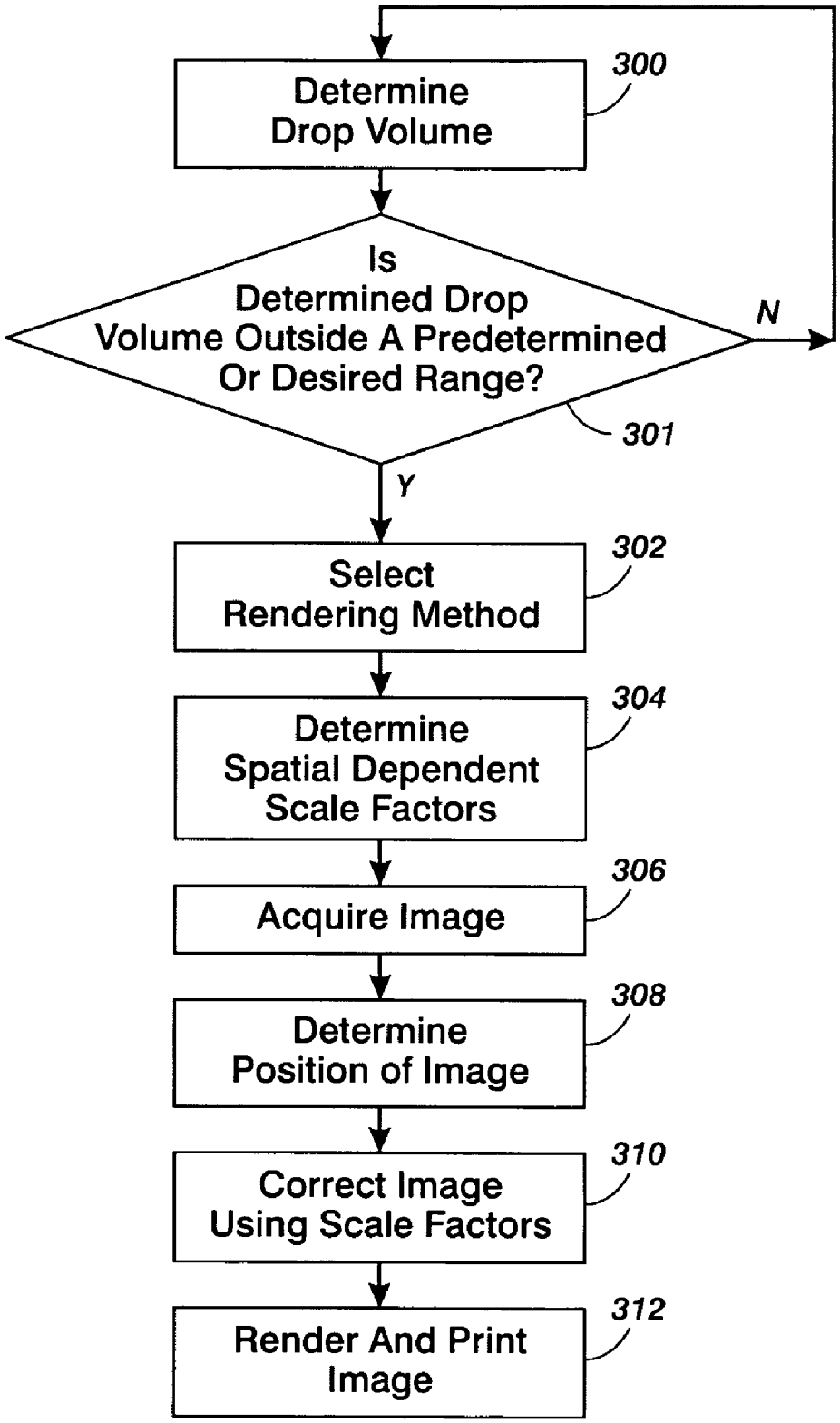
FIG. 3 is a flowchart illustrating a method in accordance with the present disclosure.

The method in accordance with the present disclosure will now be described with reference to the flowchart shown by FIG. 3 as it applies to an individual printhead. The method is performed as shown for each of the printheads 14, 15, 16 and 17 of the direct marking system 100 in order to correct for drop volume variations among all the printheads 14, 15, 16 and 17. It is provided that the method can be turned off and on with respect to each printhead, such that it is not performed for all the printheads 14, 15, 16 and 17.

At Step 300, the drop volume is determined for each printhead as a function of printhead position and/or at least one ejecting characteristic corresponding to each printhead. At Step 301, it is determined if the determined drop volume for the printhead is outside a predetermined or desired range. If it is within the range, the method continues to determine the drop volume by returning to step 300. If it is not within the range, the method proceeds to Step 302.

At Step 302, the rendering method is selected (and if halftoning, the halftone screen). At Step 304, the correction or spatial dependent scale factors are determined for each of the colors using one or more of the ink ejecting characteristics stored by the signature file 56 corresponding to each printhead, and/or as a function of each printhead's position and received input values.

At Step 306, an image is acquired, for example, from a raster image processor, scanner or a memory. At Step 308, the position of the image is then determined relative to the spatial dependent scale factors determined at Step 304. The image is then corrected at Step 310 by scaling or multiplying all input values in a region to be corrected by the appropriate spatial dependent scale factor. The image is then rendered and printed at Step 312.

It will be appreciated that variations of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

The invention claimed is:

1. An image correction method for a direct marking system having a liquid ink printer, said method comprising:

determining spatial dependent scale factors for each color of the liquid ink printer; and correcting for drop volume variations among a plurality of printheads of the liquid ink printer using at least one of the determined spatial dependent scale factors, each scale factor depending upon a ratio of target mass to average mass of ink drops deposited in a region to be corrected.

2. The method according to claim 1, wherein the step of correcting for drop volume variations includes multiplying at least one value corresponding to the region to be corrected by the at least one of the determined spatial dependent scale factors.

3. The method according to claim 1, wherein the step of determining the spatial dependent scale factors comprises the step of determining the spatial dependent scale factors for each printhead having a drop volume outside a range.

4. The method according to claim 3, wherein drop volume is determined using at least one of printhead position and at least one ejecting characteristic corresponding to each printhead.

5. The method according to claim 1, wherein the step of determining the spatial dependent scale factors includes using at least one ejecting characteristic corresponding to a printhead.

6. The method according to claim 5, wherein the at least one ejecting characteristic is selected from the group consisting of a firing pattern, a history of the firing pattern, printhead temperature, and number of drops per pixel.

7. The method according to claim 1, wherein the step of correcting includes increasing or decreasing drop volume such that the drop volume is within a range.

8. An image correction system for a direct marking system having a liquid ink printer, the image correction system comprising:

a plurality of printheads; and a controller for determining spatial dependent scale factors for each color of the liquid ink printer and correcting for drop volume variations among the plurality of printheads using at least one of the determined spatial dependent scale factors, each scale factor depending upon a ratio of target mass to average mass of ink drops deposited in a region to be corrected.

9. The system according to claim 8, wherein the controller multiplies each of a plurality of input values received by the direct marking system and corresponding to the region to be corrected by the at least one of the determined spatial dependent scale factors.

10. The system according to claim 8, wherein the controller determines drop volume for each printhead of the plurality of printheads.

11. The system according to claim 10, further comprising a file storing ejecting characteristics corresponding to one of the printheads of the plurality of printheads, and wherein the controller determines drop volume using at least one of printhead position and at least one ejecting characteristic stored by the file.

12. The system according to claim 11, wherein the at least one ejecting characteristic is selected from the group consisting of a firing pattern, a history of the firing pattern, printhead temperature, and number of drops per pixel.

13. The system according to claim 11, wherein the controller uses the at least one ejecting characteristic for determining the spatial dependent scale factors.

14. A direct marking system comprising:

a liquid ink printer having plurality of printheads; and a controller for determining spatial dependent scale factors for each color of the liquid ink printer and correcting for drop volume variations among the plurality of printheads using at least one of the determined spatial dependent scale factors, each scale factor depending upon a ratio of target mass to average mass of ink drops deposited in a region to be corrected.

15. The system according to claim 14, wherein the controller multiplies each of a plurality of input values received by the direct marking system and corresponding to the region to be corrected by the at least one of the determined spatial dependent scale factors.

16. The system according to claim 14, wherein the controller determines drop volume for each printhead of the plurality of printheads.

17. The system according to claim 16, further comprising a file storing ejecting characteristics corresponding to one of the printheads of the plurality of printheads, and wherein the controller determines drop volume using at least one of printhead position and at least one ejecting characteristic stored by the file.

18. The system according to claim 17, wherein the at least one ejecting characteristic is selected from the group consisting of a firing pattern, a history of the firing pattern, printhead temperature, and number of drops per pixel.

19. The system according to claim 14, wherein the controller uses at least one ejecting characteristic corresponding to a printhead of the plurality of printheads for determining the spatial dependent scale factors.

* * * * *